United States Patent [19]

Caulkins

[11] Patent Number: 4,733,592

[45] Date of Patent: Mar. 29, 1988

[54] PLAYER PIANO TRACKER BAR AND METHOD

[76] Inventor: Kenneth B. Caulkins, 4218 Jessup Rd., Ceres, Calif. 95307

[21] Appl. No.: 916,097

[22] Filed: Oct. 7, 1986

[51] Int. Cl.[4] ..... G10F 5/04

[52] U.S. Cl. ..... 84/151; 84/159

[58] Field of Search ..... 84/146, 149, 151–157, 84/159, 31, 32

[56] References Cited

U.S. PATENT DOCUMENTS 802,079 10/1905 De Kleist ..... 84/151

890,288 6/1908 Maerten, Jr. ..... 84/151

958,470 5/1910 Brand ..... 84/151

*Primary Examiner*—Benjamin R. Fuller

*Attorney, Agent, or Firm*—Kerkam, Stowell, Kondracki & Clarke

[57] ABSTRACT

A tracker bar for a player piano is made of two pieces which seal together without the use of gaskets. The two pieces are made of plastic and are solvent-fused together. One of the pieces, an interface member, provides for widthwise staggering of pneumatic hose connections for a single row of passages in the other piece, a registry member. The interface member has three rows of tubes and includes channels on its front or paper side to accommodate widthwise offset between the tubes and various of the passages in the registry member, which passages register with holes in the player piano paper tape.

20 Claims, 12 Drawing Figures

PLAYER PIANO TRACKER BAR AND METHOD

BACKGROUND OF THE INVENTION

This invention relates to a musical apparatus. More specifically, this invention relates to a player piano tracker bar and a method of making the tracker bar.

The use of tracker bars for player pianos is well known. Such tracker bars are disposed between two reels for the player piano paper tape. As the paper tape moves from one reel to the other, holes in the paper taper register (i.e., become in line with) holes in the tracker bar. Each hole in the tracker bar is connected by a hose to a pneumatic actuator, usually simply called a pneumatic. Upon the tracker bar sensing a hole in the paper tape, the pneumatic contracts and moves a bar attached to it, the bar in turn causing a piano key to move. Movement of the key will cause vibration of the string which corresponds to the sound of the piano.

Although tracker bars which have preciously been used have generally functioned as intended, most prior art designs have one or more of several disadvantages.

Prior art tracker bar designs are often quite difficult and/or time consuming to produce and/or assemble.

Prior art tracker bar constructions have often required the production of separate pieces or members for use with different models. For example, a tracker bar design adapted to mount to a spool frame by screw holes at the end of the tracker bar may not properly mount into an O-roll mounting. In order to produce models compatible with both spool frame mounting and the O-roll mounting (tracker bar ends have rectangular blocks, one of which accommodates a screw and the other of which fits into a mating rectangular slot) a manufacturer might be required to stock two different types of manifolds for the components of the tracker bars. The requirement to make separate pieces for the different types of mounting increases a manufacturer's cost, whereas the manufacture who limits his product to a particular type of mounting may limit the size of his available market.

A further disadvantage of numerous prior art tracker bar designs is that they may use screws and/or gaskets in assembling the tracker bar. The gaskets are used to seal off air passages to ensure proper control of the pneumatics by the tracker bar, whereas the scres may be used to hold pieces of the tracker bar together. This increases the number of parts required for assembly and mayr equire a very complex pattern for the gasket, thereby increasing the cost of production.

Some prior art tracker bar designs use glue or solder in such a way that the glue or solder may inadvertently clog or partially restrict air flow in passages.

A particular prior art transposing tracker bar 10 is shown in FIG. 1. The tracker bar 10 is "transposing" in that it includes first and second end segments 12F and 12S and middle segment 12M. The middle segment 12M is slidably mounted between the two end segments 12F and 12S so as to vary the key in which music is played. The end segments 12F and 12S are mounted by screw holes 14 such that the player piano paper tape (not shown) may move along in contact with the front (i.e., underside in the view of FIG. 1) of the segments 12F, 12M, and 12S. A thumbscrew 16 and metal rods including the visible rods 18 are used to vary the position of the middle segment 12M in between the two end segments thereby changing the key in which the music is played. Each of the segments 12F, 12M, and 12S include ridges 20 (labeled for segment 12M) which extend or project upwardly (i.e., upwardly in the view of FIG. 1) disposed between a central channel 22. Projecting upwardly from the channel 22 are a series of tubes 24. The tubes 24 are made of brass or other metal and are soldered or welded into the channel 22 to connect to one of a series of holes (not visible) which extend through to the paper tape side, (backside in the view of FIG. 1) of the tracker bar 10. The holes on the paper side of the tracker bar 10 are aligned in a single row for the middle setment 12M, this row corresponding to musical notes initiated by the paper tape as it moves in perpendicular direction to the length of the tracker bar 10. The holes on the paper side for segments 12F and 12S may be slightly widthwise offset from each other as the tubes 24 mounted upon the end segments 12F and 12S correspond to special effects controls. From the single line of note holes on the paper side of middle segment 12M, the tubes 24 obtain some widthwise offset. That is, the tubes 24 generally extend normal to the plane of view of FIG. 1 except that every other tube 24 on the middle segment 12M is inclined toward alternating ones of the ridges 20. In this fashion, hoses (not shown) may be connected to the tubes 24 to allow operation of the pneumatics from the tracker bar 10. Because of the need to weld or otherwise fix the tubes 24 in place one at a time, it is difficult, time consuming, and expensive to assemble the tracker bar 10. Further, the division of the tubes 24 into two rows is somewhat undesirable in that the pneumatics are usually arranged in three rows. Therefore, it is difficult to easily connect the hoses between the tubes 24 and pneumatics.

An alternate arrangement to that of FIG. 1 provides a non-transposing tracker bar wherein there is but a single segment. This alternate design uses a slightly greater number of tubes 24 as there is no gap between segments, but the length of the alternate tracker bar is the same as that shown in FIG. 1. Effectively, this alternate tracker bar design has a slightly longer middle segment 12M which is unitary with the end segments. No thumbscrew or metal rods 18 are necessary as this alternate non-transposing design does not include movable parts.

FIG. 2 shows an alternate prior art design for a base 30 of a tracker bar. The base 30, which is made of metal such as lead, has a front piece 32 disposed behind a back cover piece 34 in the back view of FIG. 2. Holes 36 are disposed at both ends of the base 30 in order to mount this tracker bar construction to a spool mount arrangement. The cover piece 34 includes a plurality of circular holes 38 (only some of which are labeled) which register with rectangular passages 40. The rectangular passages 40 each extend in a straight line to openings (not visible) on the front of the piece 32. Although the rectangular passages 40 are idsposed in 3 rows corresponding to the 3 rows of holes 38, it should be noted that the holes on the front of piece 32 would be disposed along a single line (with the possible exception of minor variations for passages and/or holes corresponding to special effects). Therefore, the rectangular passages 40 extend generally normal to the view of FIG. 2, but are sufficiently angularly offset from normal such that a row of the passages 40A open at holes on the front side of piece 32 which are disposed in line with the middle row 40B of passages. The middle row of passages 40B are oriented precisely normal to the view of FIG. 2, whereas the lower row of rectangular passages 40C are generally normal, but are angularly offset to mate with openings along 40B. By virtue of the angular offset of passages 40A and 40C relative to passages 40B, the passages may proceed from a common line disposed at the center of piece 32 and branch out to three seperate rows of openings. Disadvangeously, the base 30 must be attached by screws (not shown) extending into screw holes 42 to a manifold and gasket arrangement (not shown). The gasket ensures separate seals at the interface between the various holes 38 and numerous passages which are disposed in a wooden block screwed into the holes 42. The wooden block has 3 rows of tubes mounted to its top so as to allow the connection of hoses extending from the tubes to pneumatics. The necessity for a relatively complex gasket and the requirement for a large number of screws to hole the manifold against the base are undesirable features. Further, both the cover piece 34 and the front piece 32 are made of relatively heavy metal and are usually welded together.

OBJECTS AND SUMMARY OF THE INVENTION

Accordingly, it is a primary object of the present invention to provide a new and improved musical apparatus. (As used herein, a "musical apparatus" refers to a device or assembly used, by itself or with other devices or assemblies, to produce music.)

A more specific object of the present invention is to provide a new and improved tracker bar. (As used herein, a "tracker bar" is a device which reads holes in a player piano paper tape.)

A further object of the present invention is to provide a tracker bar which is relatively simple in construction and inexpensive.

A still further object of the present invention is to provide a tracker bar which does not require the use of gaskets to seal air passages.

Another object of the present invention is to provide a tracker bar which is adaptable to various different formats including spool mounting, O-ring mounting, and/or transposing models without requiring the construction of totally separate major components.

Yet another object of the present invention is to provide a tracker bar using plastic for primary components, but which may include metal reinforcing rods to maintain rigidity.

A still further object of the present invention is to provide a tracker bar which may be conveniently attached to pneumatics in constructing a player piano.

A still further object of the present invention is to provide a new and improved player piano using the present tracker bar.

Yet another object of the present invention is to provide a new and improved method of making a musical apparatus, specifically a tracker bar.

The above and other objects of the present invention which will become apparent as the description proceeds are realized by a musical apparatus comprising a tracker bar having: a registry member with a series of passages for registering to paper holes from a player piano paper tape, the passages being spaced in a lengthwise direction, each passage extending from a first opening from a first side of the registry member through to a second opening on a second side of the registry member; and an interface member having a base with first and second sides and a plurality of tubes extending from the second side of the base, the first side of the base being fixed to the second side of the registry member, the interface member having a plurality of ducts therein, each duct extending from the first side of the base through to an open end of a corresponding one of the tubes and each duct communicates with a corresponding one of the passages to define a flow path from each of the first openings to corresponding open end of one of the tubes. The tubes include at least three rows extending lengthwise, each row spaced from each other row in a width direction perpendicular to the length direction. The interface member is made of plastic and the tubes are integral with the base, meaning that they are formed initially as a unit. The passages extend completely in parallel to each other and extend in depth direction perpendicular to the length and width directions. The registry member is made of plastic. The first side of the base is solvent-fused into the second side of the registry member. The registry member and the interface member are connected together by at least two plastic prongs extending into two corresponding holes. Each of the flow paths is completely sealed between the corresponding one of the open ends and the corresponding one of the first opening exclusively by the interface member and the registry member, meaning that no gaskets are required over this path. A plurality of the flow paths further include a channel at the interface between the first side of the base and the second side of the registry member, each of the channels extending in a common plane in a widthwise direction to connect a corresponding one of the passages to a widthwise offset corresponding one of the ducts. Each of the passages and each of the ducts extend completely in parallel with each other, and each of the passages and each of the ducts extend in a depth direction perpendicular to the length and width directions. The registry member includes two lips extending lengthwise between a depression and the base is fixed into the depression between the lips to define two lengthwise extending grooves. The tracker bar further includes at least two metal reinforcing bars, each bar extending in one of the grooves. The tracker bar is a transposing tracker bar having a middle segment connected by one or more of the bars to two end segments and comprising an adjustor to change the position of the middle segment relative to the end segments. The tracker bar may further include a plurality of blocks fixd in the grooves and having holes in which at least some of the bars are seated. One embodiment of the invention uses mounting holes extending through the registry member and the interface member for spool mounting of the bar. An alternate arrangement has two mounting blocks extending lengthwise from opposite ends of the second side of the interface member, the mounting blocks being operable for O-roll mounting of the tracker bar. The musical apparatus may be a player piano which further comprises a plurality of pneumatics operable to control a plurality of keys, each pneumatic being connected to a corresponding one of the tubes by a hose. Each of the channels may extend in the first side of the interface member.

The present invention further includes a method of making a musical apparatus comrising the steps of: producing a plastic registry member having the features described above; producing a plastic interface member having the features described above; applying a plastic solvent to at least one of the first side of the base and the second side of the registry member; and fusing the first side of the base to the second side of the registry member by clamping them together after the application of the plastic solvent, each duct communicating with a corresponding one of the passages to define a flow path from each of the first openings to a corresponding open end of one of the tubes. The registry member and interface member may each be produced with flash over break out sections which register with each other.

BRIEF DESCRIPTION OF THE DRAWINGS

The above and other objects, features, and advantages of the present invention will be more readily understood when the following detailed description is considered in conjunction with the accompanying drawings wherein like characters represent like parts througout the several views and in which.

DETAILED DESCRIPTION

Figure 1:
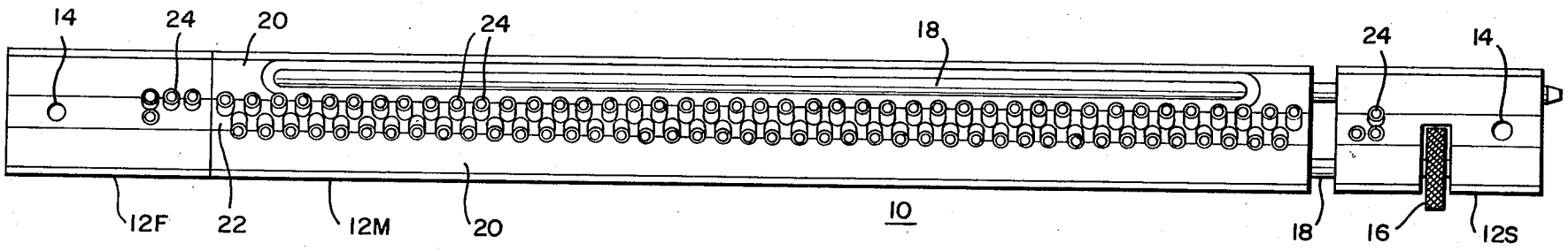
FIG 1 PRIOR ART
FIG. 1 shows a back (i.e., side which would be disposed away from the player piano paper tape) view of a prior art transposing tracker bar design.
Figure 2:
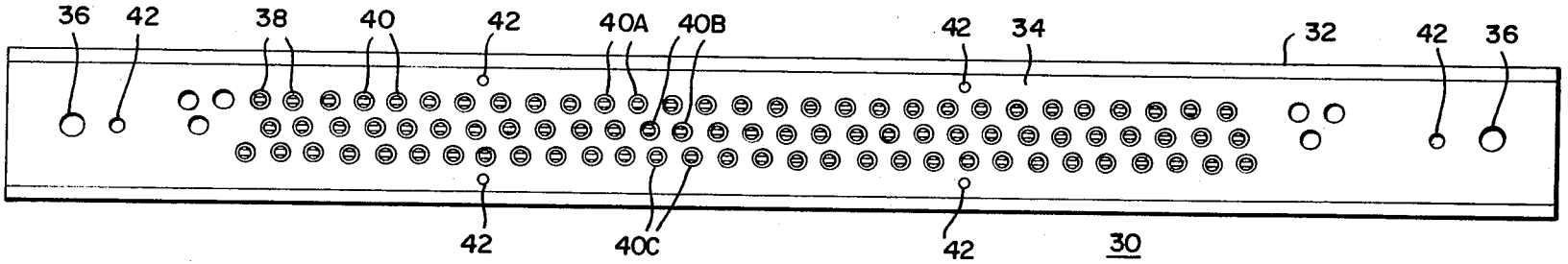
FIG 2 PRIOR ART
FIG. 2 shows a back view of a base of another prior art tracker bar design.
Figure 3:
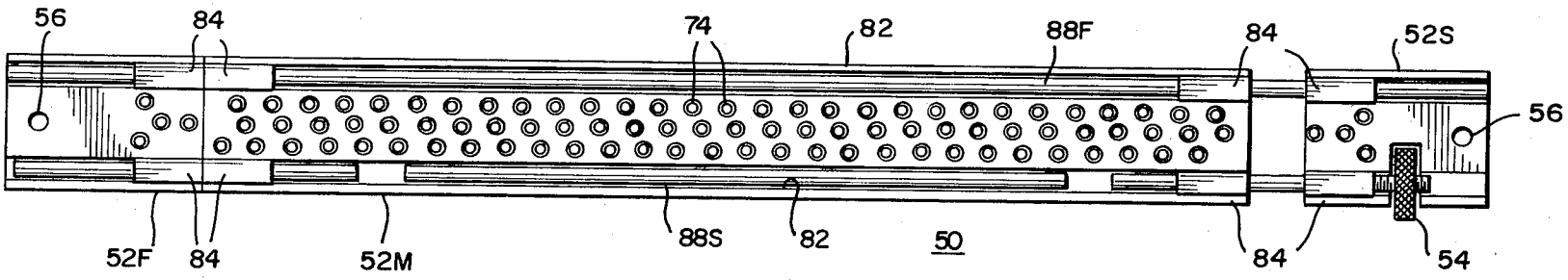
FIG. 3 shows a back or tube side view of a transposing embodiment tracker bar according to the present invention.
Figure 4:
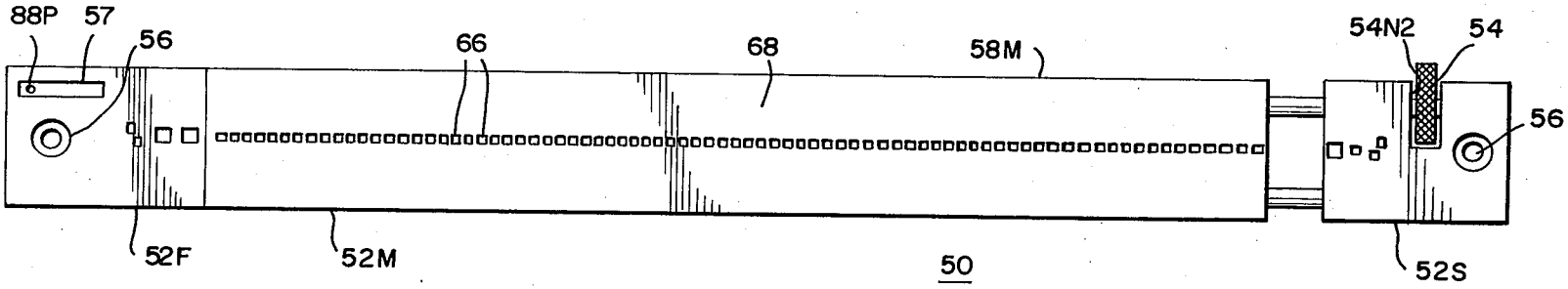
FIG. 4 shows a front or paper tape side view of the tracker bar of FIG. 3.

A transporsing tracker bar 50 according to the present invention will be discussed by reference to the back view of FIG. 3 and the front view of FIG. 4. The tracker bar 50 includes first and second end segments 52F and 52S respectively and a middle segment 52M. In generally similar fashion to the prior art design of FIG. 1, a thumbscrew 54 is used to vary the position of the middle segment 52M between the two end segments 52F and 52S, thereby shifting the key in which music read by the tracker bar 50 is played. The end segments 52F and 52S would be spool-mounted by way of screw holes 56.

Continuing to view FIGS. 3 and 4, but also considering the exploded view of FIG. 6, the details of construction of the parts of tracker bar 50 will be discussed. Each of the segments 52F, 52M, and 52S comprises a registry member 58F, 58M, and 58S respectively and an interface member 60F, 60M, and 60S respectively. Each of the registry members and each of the interface members are made of plastic As each of the registry segments 58F, 58M, and 58S are constructed in generally similar fashion and each of the interface segments 60F, 60M, and 60S are constructed in generally similar fashion, the discussion which follows will concentrate on the construction of registry member 58M and interface member 60M.

The registry member 58M includes lips 62 extending lengthwise along the sides of the member. Between the lips 62 is a depression 64 also extending lengthwise and having a series of passages 66 disposed therein. Each of the passages 6 is parallel to the other passages 66 and extends in a depthwise direction perpendicular to the length direction (i.e., the direction in whcih lips 62 extend) and a widthwise direction (i.e., the direction from one of the lips 62 to the other of the lips 62). The depthwise extending passages 66 have the visible first openings as shown on the front side 68 of 58M and extend to second openings visible where the passages 66 exit from the back or second side 70 (see FIG. 6) of the member 58M.

The member or segment 60M includes a base 72 having a first or front side (not visible in the views of FIGS>3, 4, and 6), and a back or second side 72S having a plurality of tubes 74 extending therefrom. The tubes 74 are, like the base 72 and the members 58F, 58M, 58S, 60F, and 60S, made of plastic. Further, the tubes 74 are integral with the base 72S formed at the same time and of the same material as the base 72. Each of the tubes 74 corresponds to a duct 76 which extends from the front or paper tape side of base 72 through the tube 74 to an open upper end 78 of the tube 74. Each of the ducts 76 corresponds to one of the passages 66 and communicates with the corresponding passage 66. The base 72 includes a series of channels (not shown here, but discussed in detail below with respect to FIG. 10) which convert the single row of passages 66 into three rows of ducts 76 corresponding to the three rows of tubes 74 which are widthwise offset from each other.

The interface member 60M fits within the depression 64 in the registry member 58M with upwardly extending plastic prongs 80P (FIG. 6 only) mating into corresponding holes (not visible in these figrues, but discussed in detail below with respect to FIG. 10) in the interface member 60M. The interface member or members are solvent-fused into the depressions in their corresponding registry members by a process discussed in detail below. When the interface member 60M is disposed within the depression 64, there are two grooves 82 (see FIG. 3) between the base 72 and the two lips 62. Plastic blocks 84, each of which is identically constructed and includes a hole 86, are mounted within the grooves 82, therebeing two of the plastic blocks 84 mounted in each of the end segments 52F and 52S and four of the blocks 84 mounted in the middle segment 52M. A first metal reinforcing rod 88F extends through the holes in four of the spacers 84 and is fixed by glue or other means to the two end segments 52F and 52S extending through four of the holes 86 in the four blocks 84. The rod 88F slidably supports the middle segment 52M. A second metal reinforcing rod 88S is simply glued in place in one of the grooves 82 and is fixed relative to segment 52M. This rod reinforces the plastic material of the registry members and interface members. A third metal or steel rod 88T extends through two of the holes 86 and is fixed to the middle segment 58M and slidable relative to the end segment 58F such that a pointer 88P (FIG. 6 only) may slide within a slot 57 (FIG. 4) such that the position fo the pointer 88P indicates the key in which the music is being played. A fourth steel rod 88R includes threads to accommodate the thumbwheel 54 extending through associated notches 54N2 and 54N2 and is secured to the middle segment 58M and slidably mounted relative to the end segment 58S. Screw holes 90 are used for spool-mounting the tracker bar 50 and adjustment of the thumbscrew 54 may change the key by sliding the middle segment 58M in between the two end segments 58F and 58S.

Figure 6:
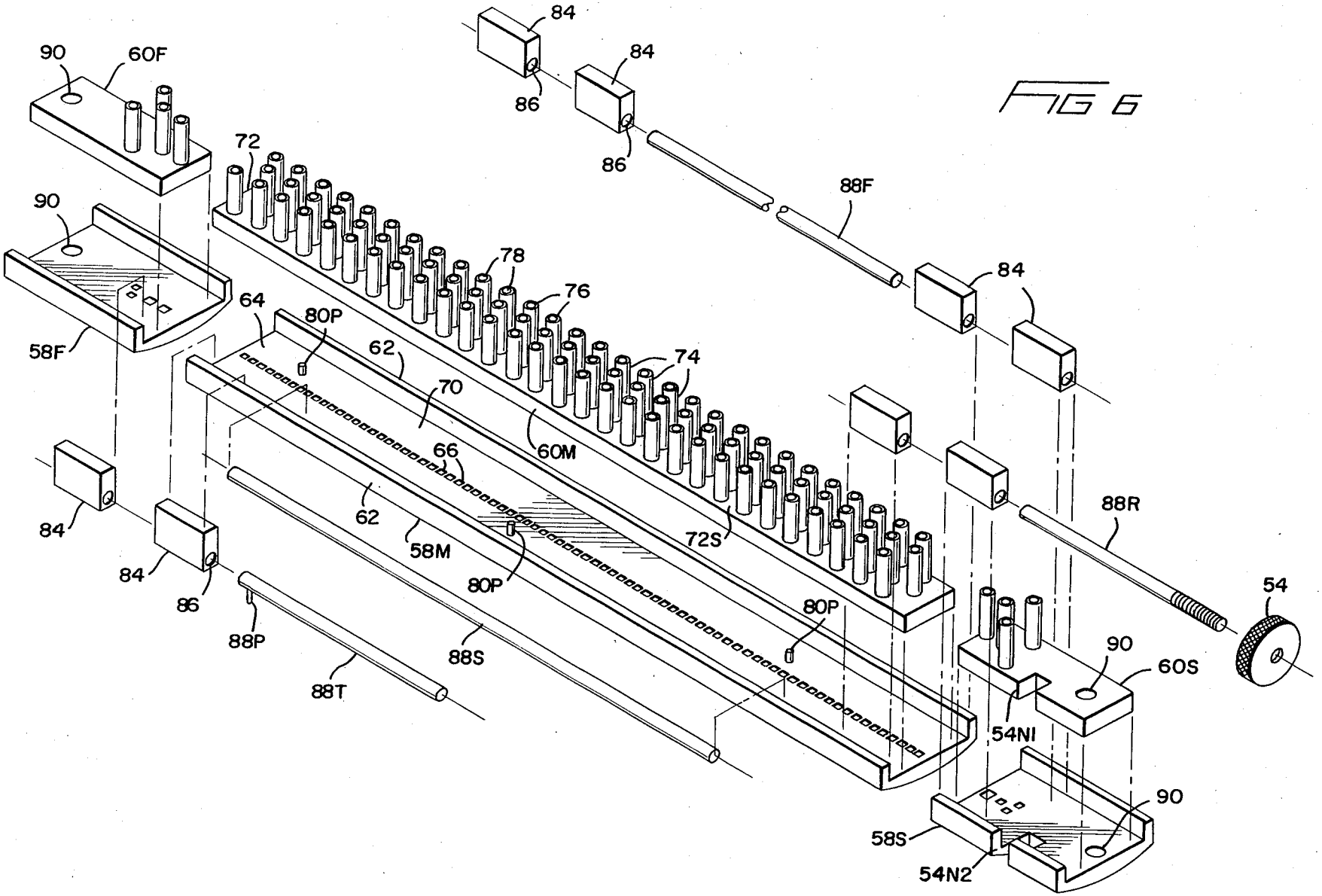
FIG. 6 shows an exploded view of the tracker bar of FIG. 3.

As shown in FIG. 6, the tubes 74 have tubular outer surfaces. As also apparent from FIG. 6, the flow path from each opening of each passage 66 on the underside of the registry member 58 to the corresponding open end 76 of one of tubes 74 is partially bounded by the boundary between the underside (in FIG. 6) of base 72 and the upper side (top in FIG. 6) 70 of the registry member. as also appears from FIG. 6, this boundary between this underside and this upper side is the only boundary between different pieces which bounds any of these flow paths.

Figure 5:
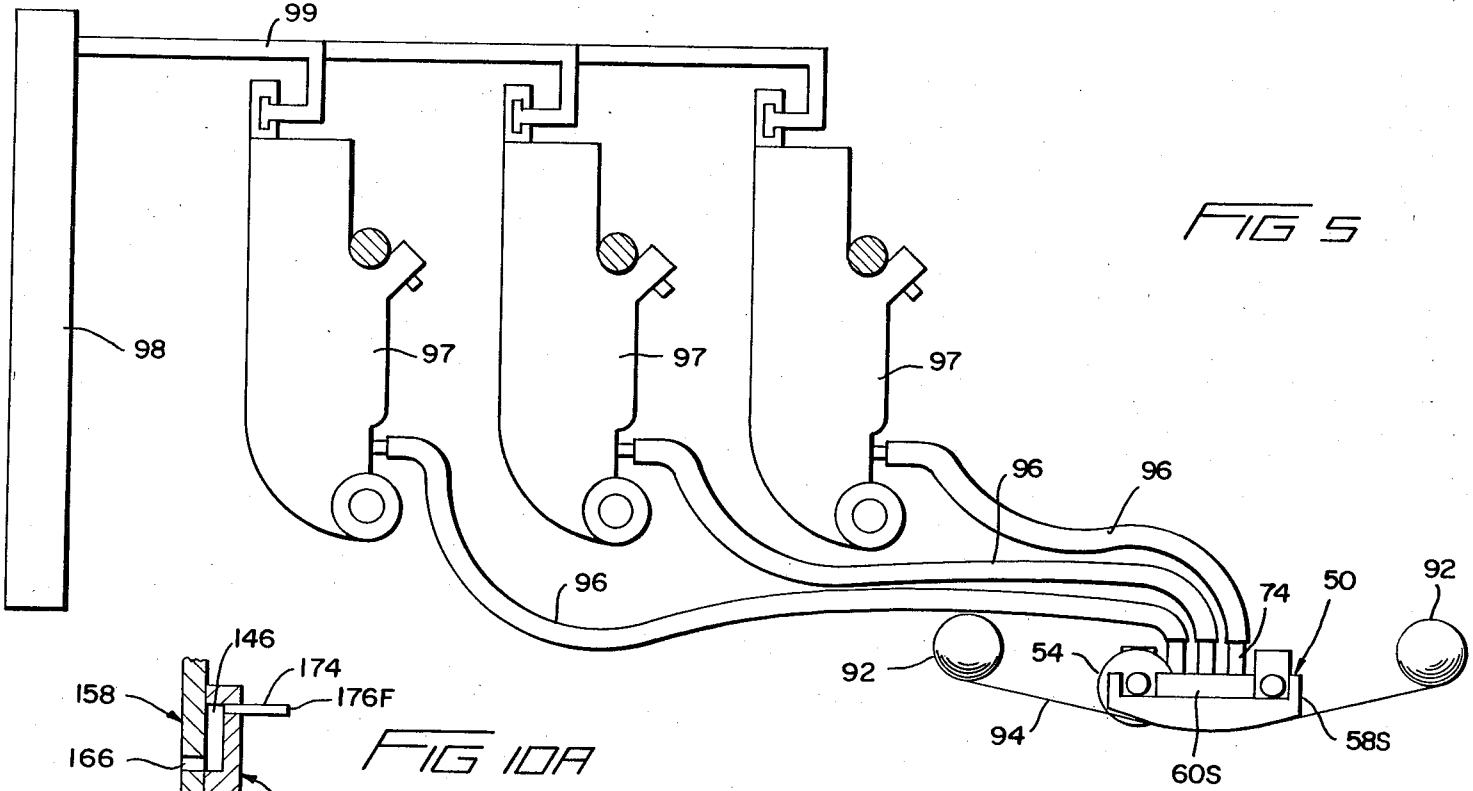
FIG. 5 shows a simplified schematic of the connections between the tracker bar of FIG. 3 and 4 and several pneumatics.

With reference now to the schematic of FIG. 5, the operation of the present invention will be described. The tracker bar 50 is mounted between two wheels 92 having a paper tape 94 extending there between such that the front side of the registry members 58F, 58M, and 58S have the paper tape 94 extending across them. When holes on the paper tape (holes not shown) register or line up with corresponding ones of the passages 66 (refer back to FIG. 6) air may proceed through the corresponding tube or tubes 74 to hoses 96 thereby changing the state of pneumatics 97, each of which may be used to play a piano key 98 by way of a control rod 99. As shown, the pneumatics 97 are usually mounted in three separate rows (only the first unit of each row is visible). Therefore, the use of three rows of the tubes 74 allows one to easily connect the various hoses 96 with a minimal chance of error. Note that the tubes 74 mounted uponthe end segments or end interface members 60F and 60S may be used to control special effects devices or instruments (not shown). It will also be readily appreciataed that the tracker bar 50 may also be used to control instruments other than player pianos provided that such musical instruments are operated by paper tapes. For example, some arrangements allow for operation of xylophones, banjos, and tambourines by such tracker bars. Accordingly, the tracker bar 50 caneasily be used to read paper tapes in connection with such other musical instruments.

The pneumatics 97 could be constructed as disclosed in the present inventor's prior patent application Ser. No. 728,937, filed Apr. 30, 1985, entitled "MUSICAL INSTRUMENT PNEUMATIC ACTUATOR", now U.S. Pat. No. 4,619,177 issued Oct. 28, 1986. That application discloses the use of solvent to hold a bellows to a plastic piece.

Figure 10A:
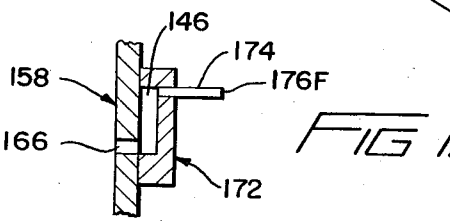
FIG. 10A shows a cross-section view taken along lines 10A—10A of FIG. 10.
Figure 10:
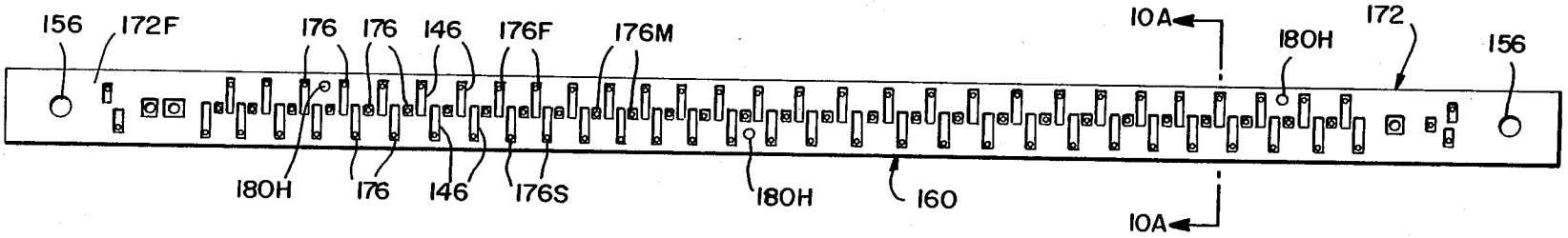
FIG. 10 shows a front view of an interface member used with the present invention.
Figure 7:
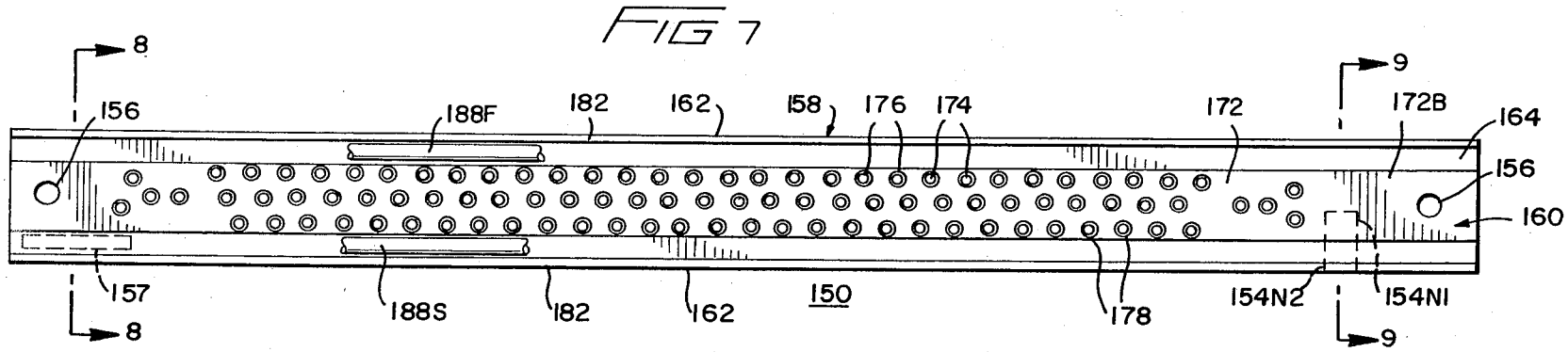
FIG. 7 shows a non-transposing tracker bar according to the present invention.
Figure 9:
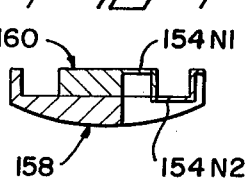
FIG. 9 shows a cross-section view taken along lines 9—9 of FIG. 7.
Figure 8:
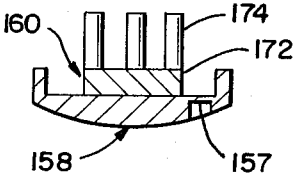
FIG. 8 shows a cross-section view taken along lines 8—8 of FIG. 7.

A non-transposing tracker bar 150 according to the present invention is shown in FIGS. 7, 8, 9, and 10. FIG. 7 is a back view of the tracker bar 150, whereas FIGS. 8 and 9 are cross-section views taken along lines 8—8 and 9—9 respectively. FIG. 10 is a front view of an interface member 160 as used with the tracker bar 150. The components of tracker bar 150 are labeled in the 100 series with the same last two digits as the corresponding part of the tracker bar 150 with the exception that parts in FIGS. 7–10 labeled with numbers less than 150 do not have a corresponding part in the embodiment of FIGS. 3–6. It should initially be noted that the tracker bar 150 is constructed in essentially similar fashion to tracker bar 50 except that the end segments are incorporated or unitary with the middle segment. The tracker bar 150 has a registry member 158 having lips 162 extending lengthwise thereon to define a lengthwise extending depression 164 in whcih the interface member 160 is disposed. Grooves 182 which run lengthwise to lips 162 accommodate first and second steel or metal reinforcing rods 188F and 188S. Although the rods are only partiallly shown in FIG. 7 and are deleted from the views of FIGS. 8 and 9, it will be readily appreciated that they would preferrably run the entire length of the grooves 182 and, thus, the entire length of the tracker bar 150. The tracker bar 150 does not use any blocks such as 84 in the embodiment of FIGS. 3–6. The interface member 160 includes a base 172 having a front or first side 172F (FIG. 10 only) and a back or second side 172B (FIG. 7). A plurality of tubes 174 extend from the second side 172B and are plastic formed integrally with the plastic base 172. Each of the tubes 174 has ducts 176 extending between the first side 172F (see the circular duct openings in FIG. 10) to open ends 178 (FIG. 7).

The overall length of the tracker bar 150 would be the same as tracker bar 50, tracker bar 150 including several more of the tubes 174 than the tubes 74 included in tracker bar 50. Although not visible in FIGS. 7–10, the front side of the registry member 158 includes a series of the passages 66 and has a similar pattern as the pattern shown in FIG. 4 except that no thumbscrew 54, thumbscrew notch 54N2, slot 57, and pointer 88P would be used.

Each of the ducts 176 in the interface 160 extend depthwise (i.e., normal to the plane of view of FIG. 10 and theplane of view of FIG. 7). In addition to having all of the ducts 176 extending parallel to each other, each of these ducts 176 extend parallel to each of the passages (not shown in FIGS. 7–10 but correspond to passages 66 in FIG. 4). In order to interface the single row of passages to the three rows of tubes 174, the front side 172F of base 172 includes a series of channels 146 which allow a first side row of ducts 176 and a second side row of ducts 176S to communicate with a series of passages within the registry member 158 which are in line with a middle series of ducts 176M. Each of the channels 146 allows communicatin between the ducts 176 and the corresonding passage 166 in the manner shown in FIG. 10A, a cross-section taken along lines 10A of FIG. 10 and which only partially illustrates the registry member 158. As shown by FIG. 10A, the channel 146 extends in a widthwise direction perpendicular to the length of the tracker bar 150 and also perpendicular to the parallel depth-extending passages 166 and ducts 176. FIG. 10A is somewhat simplified in that only one of the tubes 174 is shown.

The operation of the tracker bar 150 is essentially the same as the tracker bar 50. The tracker bar 150 is different from tracker bar 50 in that that tracker bar 150 does not include any arrangement for moving a segment of the tracker bar in a lengthwise direction so as to transpose notes or shift the key in which the music is played.

As illustrated in FIGS. 7 and 8, the registry member 158 may include a flash over break out section 157. Additionally, as shown by FIGS. 7 and 9, the registry member 158 and interface member 160 may respectively include flash over break out sections 154N2 and 154N1. The three break out sections are places where the plastic has been made very thin so as to facilitate easy removal of the sections by pushing against the surface. Additionally, the borders of the break out sections may include alternating slits and solid portions such that the plastic breaks out uniformly along the border. The purpose of the break out sections is discussed below with respect to the construction of the tracker bars.

The construction of the tracker bars 50 and 150 is relatively straightforward. In particular, a plastic interface member 160 (FIGS. 7–10) is produced by injection molding or other convenient process such that the tubes 174 are integral with the base 172 meaning that they are unitarily constructed at the same time and through the same step as the base 172. Advantageously, this avoids the necessity of soldering, welding, glueing, or otherwise affixing each of the tubes 174 to the base 172.

A plastic registry member 158 is produced by injection molding or a similar process. The registry member advantageously is 1.2 inches wide to help in airtight sealing of player piano paper tape being moved across it.

In order to connect the registry member 158 to the interface member 160, solvent is applied to the members to dissolve the surface plastic at least upon one (preferably both) of the front surface of interface member 160 and the back surface of registry member 158. The members 158 and 160 may simply be dipped in a solvent, such as alcohol, if desired. The interface member is then snapped onto the registry member 158 by virture of holes 180H (FIG. 10 only) fitting into mating plastic prongs (such as 80P shown in FIG. 6 only). The mating prongs and holes ensure porper positioning of the interface member 160 relative to the registry member 158. The two pieces are then clamped together and within a very short period of time (about 15 seconds) the plastic which was softened by the application of the plastic solvent will harden thereby fusing and bonding the two pieces together. Further, the use of the plastic solvent will seal the various flow paths defined by the ducts 176, passages 166, and channels 146 without the danger of glue or other foreign debris clogging any of the passages.

Several options are available to finalize construction of the tracker bar following completion of the above steps. In particular, one may simply glue or otherwise fix the steel reinforcing rods 188F and 188S lengthwise substantially along the length of the tracker bar to realize a tracker bar 150 as shown in FIG. 7. Alternately, if one wishes to construct a transposing tracker bar 50, one may simply cut the combination of interface member 160 and registry member 158 into three separate segments, the middle segment having two separate additional end cuts made in it so that the combination of a first segment 52F, middle segment 52M, and second end segment 52S as shown in FIG. 3 will include a gap when the holes 56 in FIG. 3 are spaced the same distance as the holes 156 in the FIG. 7 embodiment. This may involve cutting off and disposing of two small sections corresponding to between one and four of the tubes 174. Next, one may simply break out the sections 157, 154N1, and 154N2 to respectively realize the slot 57 (FIG. 4) and the notches 54N1 and 54N2 (FIG. 6). Alternately, one could have broken out the sections prior to combining the registry member 158 and the interface member 160. One may now glue the blocks 84 and the various reinforcing rods in place and mount the thumb wheel 54. Because the air passages have already been selaed by the use of the plastic solvent, the glue can not clog any of the various air passageways.

From the above description, it should be appreciated that the registry member 158 and the interface member 160 of FIGS. 7–10 are used to construct the non-transposing tracker bar 150 and the transposing tracker bar 50. Accordingly, it is unnecessary to have molds to produce separate registry members and/or interface members for the separate embodiments.

Figure 11:
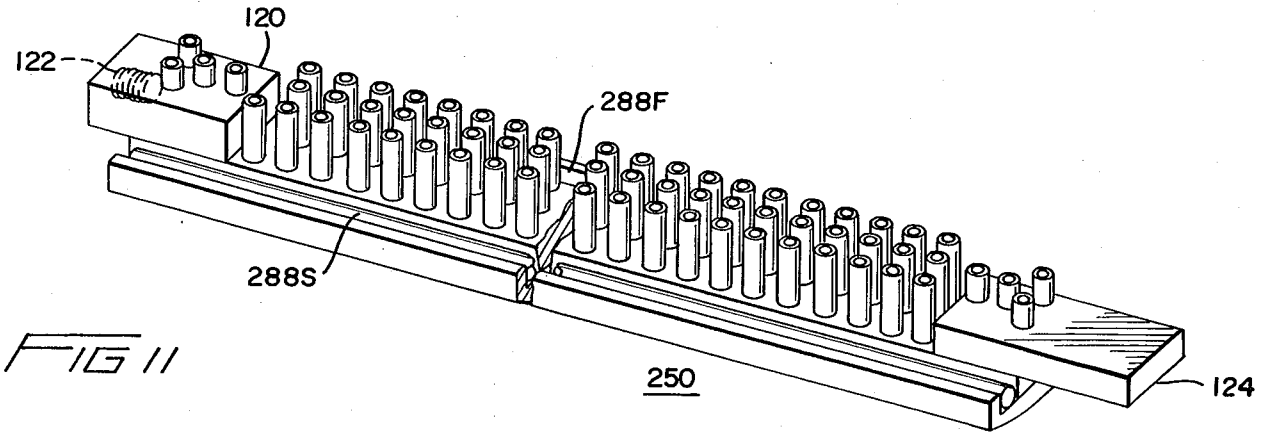
FIG. 11 shows a perspective view of an O-ring mounting embodiment of the present invention.

With reference now to FIG. 11, a perspective view of an O-ring mount tracker bar 250 is shown. As the tracker bar 250 is substantially similar to tracker bar 150, only the differences between tracker bar 250 and tracker bar 150 wil be discussed. The tracker bar 250 may be constructed from the arrangement of FIG. 7 bu cutting off the very ends of tracker bar 150 of FIG. 7, the ends including the screw holes 156. The steel reinforcing 288F and 288S would be sufficiently short to be added after the cutting without extending beyond the ends of the tracker bar or, alternately, be previously mounted to avoid the location of the cuts. An additional alternative might be to cut the reinforcing rods, but this would not be necessary.

Instead of using screw holes 56 for mounting, the tracker bar 150 uses an O-ring mounting arrangment wherein a plastic block 120 is fixed to one end of the tracker bar 250. The block 120 includes four holes to accommodate the tubes extending at the end of the tracker bar 250. Additionally, the block 120 includes a lengthwise extending threaded hole 122 to mate with a screw for securing one end of tracker bar 250. The opposite end of the tracker bar 250 includes a block 124 whihc will fit into a slot (not shown) to secure that end of the tracker bar 250.

It will therefore be appreciated that the construction of the interface member 160 and registry member 158 will, with the use of several alternate small pieces, allow one to construct any of the tracker bars 50, 150, or 250. Therefore, the arrangements of the present invention may easily accommodate themselves to construction of a transposing tracker bar, a non-transposing spool mount tracker bar, and a non-transposing O-ring mount tracker bar.

Although the above description has included various specific details, materials, and features, it will be readily appreciated that many of the specifics are included fo rllustrative purposes only. Various modification and adaptations will be readily apparent to those of skill in the art. Accordingly, the scope of the present invention should be determined by reference to the claims appended hereto.

What is claimed:

1. A musical apparatus comprising a tracker bar having:

(a) a registry member with a series of passages for registering to paper holes from a player piano tape, said passages being spaced in a lengthwise direction, each passage extending from a first opening on a first side of said registry member through a second opening of a second side of said registry member; and (b) an interface member having a base with first and second sides and a plurality of tubes extending from said second side of said base, said first side of said base bieng fixed to said second side of said registry member, said interface member having a plurality of ducts therein, each duct extending from said first side of said base through to an open end of a corresponding one of said tubes and each duct communicates with a corresponding one of said passages to define a flow path from each of said first openings to a corresponding open end of one of said tubes; and wherein said tubes include at least 3 rows extending lengthwise, each row spaced froeach other row in a width direction perpendicular to said length direction, and wherein said interface member is made of plastic and said tubes are integral with said base, and wherein each of said tubes has a tubular outer surface, and wherein the boundary between said second side of said registry member and said first side of said base of said interface member is the only boundary between different pieces which bounds any of said flow paths.

2. The musical apparatus of claim 1 wherein said passages extend completely in parallel to each other and extend in a depth direction perpendicular to said length and width directions.

3. The musical apparatus of claim 1 wherein said registry member is made of plastic and said first side of said base is solvent-fused to said second side of said registry member.

4. The musical apparatus of claim 3 wherein said registrymember and said interface member are connected togehter by at least two plastic prongs extending into corresponding two holes.

5. The musical apparatus of claim 3 wherein each of said flow paths is completely sealed between the corresponding one of said open ends and the corresponding one of said first oenings exclusively by said interface member and said registry member.

6. The musical apparatus of claim 3 wherein a plurality of said flow paths further include a channel at the interface between said first side of said base and said second side of said registry member, each of said channels extending in a common plane in a widthwise direction perpendicular to said lengthwise direction to connect a corresponding one of said passages to a widthwise offset corresponding one of said ducts.

7. The musical apparatus of claim 6 wherein each of said passages and each of said ducts extend completely in parallel with each other, and each of said passages and each of said ducts extend in a depth direction perpendicular to said length and width directions.

8. A musical apparatus comprising a tracker bar having:

(a) a registry member with a series of passages for registering to paper holes from a player piano tape, said passages being spaced in a lengthwise direction, each passage extending from a first opening on a first side of said registry member through a second opening on a second side of said registry member; and (b) an interface member having a base with first and second sides and a plurality of tubes extending from said second side of said base, said first side of said base being fixed to said second side of said registry member, said interface member having a plurality of ducts therein, each duct extending from said first side of said base through to an open end of a corresponding one of said tubes and each duct communicates with a corresponding one of said passages to define a flow path from each of said first openings to a corresponding open end of one of said tubes; and wherein said tubes include at least 3 rows extending lengthwise, each row spaced from each other row in a width direction perpendicular to said length direction, and wherein said interface member is made of plastic and said tubes are integral with said base, wherein said registry member is made of plastic and said first side of said base is solvent-fused to said second side of said registry member, and wherein a plurality of said flow paths further include a channel at the interface between said first side of said base and said second side of said registry member, each of said channels extending in a common plane in a widthwise direction perpendicular to said lengthwise direction to connect a corresponding one of said passages to a widthwise offset corresponding one of said ducts, and wherein each of said passages and each of said ducts extend completely in parallel with each other, and each of said passage and each of said ducts extend in a depth direction perpendicular to said length and width direction, and wherein said registry member includes two lips extending lengthwise between a depression and said base is fixed into said depression between said lips to define two lengthwise extending grooves, and said tracker bar includes at least two reinforcing metal bars, each metal bar extending in one of said grooves.

9. The musical apparatus of claim 8 wherein said tracker bar is a transposing tracker bar having a middle segment connected by one or more of said metal bars to two end segments, and comprising an adjustor to change the position of said middle segment relative to said end segments.

10. The musical apparatus of claim 9 further comprising a plurality of blocks fixed in said grooves and having holes in which at least some of said bars extend.

11. The musical apparatus of claim 8 further comprising mounting holes extending through said registry member and said interface member for spool mounting of said tracker bar.

12. The musical apparatus of claim 8 further comprising two mounting blocks extending lengthwise from opposite ends of said second side of said interface member, said mounting blocks for operable O-roll rounding of said tracker bar.

13. The muscial apparatus of claim 1 wherein said musical apparatus is a player piano and further comprises a plurality of pneumatics operable to control a plurality of keys, each pneumatic being connected to a corresponding one of said tubes by a hose.

14. A musical apparatus comprising a tracker bar having:

(a) a registry member with a series of passages for registering to paper holes from a player piano tape, said passages being spaced in a lengthwise direction, each passage extending from a first opening on a first side of said registry member through a second openign on a second side of said registry member; and (b) an interface member having a base with first and second sides and a plurality of tubes extending from said second side of said base, said first side of said base being fixed to said second side of said registry member, said interface member havig a plurality of ducts therein, each duct extending from said first side of said base through to an open end of a corresponding one of said tubes and each duct communicates with a corresponding one of said passages to define a flow path from each of said first openings to a corresponding open end of one of said tubes; and wherein a plurality of said flow paths further include a channel at the interface between said first side of said base and said second side of said registry member, each of said channels extending in a common plane in a widthwise direction perpendicular to said lengthwise direction to connect a corresponding one of said passages to a widthwise offset corresponding one of said ducts, and wherein said interface member and said registrymember are both made of plastic and said tubes are integral with said base, and wherein said first side of said base is solvent-fused to said second side of said registry member.

15. The musical apparatus of claim 14 wherein each of said channels is a channel recessed in said first side of said interface member.

16. The musical apparatus of claim 15 wherein each of said passages and each of said ducts extend completely in parallel with each other, and each of said passages and each of said ducts extend in a depth direction perpendicular to said length and width directions.

17. The musical apparatus of claim 14, and wherein the boundary between said second side of said registry member and said first side of said base of said interface member is the only boundary between different pieces which bounds any of said flow paths.

18. The musical apparatus comprising a tracker bar having:

(a) a registry member with a series of passages for registering to paper holes from a player piano type, said passages being spaced in a lengthwise direction, each passage extending froma first opening on a first side of said registry member through a second opening on a second side of said registry member; and (b) an interface member having a base with first and second sides and a plurality of tubes extending from said second side of said base, said first side of said base being fixed to said second side of said registry member, said interface member having a plurality of ducts therein, each duct extending from said first side of said base through to an open end of a corresponding one of said tubes and each duct communicates with a corresponding one of said passages to define a flow path from each of said first openings to a corresponding open end of one of said tubes; and wherein a plurality of said flow paths further include a channel at the interface between saif first side of said base and said second side of said registry member, each of said channels extending in a common plane in a widthwise direction perpendicular to said elngthwise direction ot connect to corresponding one of said passages to a widthwise offset corresponding one of said ducts, and wherein each of said channels is a channel recessed in said first side of said interface member, and wherein each of said passages and each of said ducts extend completely in parallel with each other, adn each of said passages and each of said ducts extend ina depth direction perpendicular to said length and width directions, and wherein said interface member and said registry member are both made of plastic and said tubes are integral with said base, and wherein said first side of said base is solvent-fused to said second side of said registry member, wherein said registry member includes two lips extending lengthwise between a depression and said base is fixed into said depression between said lips to define two lengthwise extending grooves, and wherein said musical apparatus is a player piano and further comprises a plurality of keys, each pneumatic being connected to a corresponding one of said tubes by a hose.

19. A method of making a musical apparatus comprising the steps of :

producing a plastic registry member with a series of passages for registering to paper holes from a player piano paper tape, said passages being spaced in a lengthwise direction, each passage extending from a first opening on a first side of said registry member through to a second opening on a second side of said registry member; producing a plastic interface member having a base with first and second sides and a plurality of tubes extending from said second side of said base, said interface member having a plurality of ducts therein, each duct extending from said first side of said base through to an open end of a corresponding one of said tubes;

applying a plastic solvent to at least one of said first side of said base and said second side of said registry member; and fusing said first side of said base to said second side of said registry member by clamping them together after the application of said plastic solvent, each duct communicating with a corresponding one of said passages to define a flow path from each of said first openings to a corresponding open end of one of said tubes.

20. The method of making a musical apparatus of claim 19 wherein said registry member and said interface member are each produced with flash over break out sections.

* * * * *